United States Patent [19]

Neuhof et al.

[11] 4,065,767

[45] Dec. 27, 1977

[54] PROGRAMMABLE ELECTRONIC SIREN

[75] Inventors: Jacob Neuhof, Norwalk, Conn.; Robert D. Scott, Owen Sound, Canada

[73] Assignee: General Signal Corporation, Rochester, N.Y.

[21] Appl. No.: 719,644

[22] Filed: Sept. 1, 1976

[51] Int. Cl.[2] ..... G08B 3/00

[52] U.S. Cl. ..... 340/384 E; 340/384 R

[58] Field of Search ..... 340/384 E, 384 R; 331/47, 64

[56] References Cited

U.S. PATENT DOCUMENTS

| | | | |
|---|---|---|---|
| 3,137,846 | 6/1964 | Keeling | 340/384 E |
| 3,882,275 | 5/1975 | Carroll | 340/384 E |
| 3,889,256 | 6/1975 | Cieslak | 340/384 E |
| 3,905,016 | 9/1975 | Peterson | 340/384 E |

*Primary Examiner*—Harold I. Pitts

*Attorney, Agent, or Firm*—Milton E. Kleinman; George W. Killian

[57] ABSTRACT

A dynamic loudspeaker is driven by chopped d.c. from the collector of a transistor. A free wheeling diode is connected in parallel with the speaker circuit to dissipate the inductive energy in the speaker voice coil when the transistor is turned off. The transistor is controlled by a voltage controlled oscillator which, under control of other elements, can be made to produce a wide variety of cyclically varying output signals for producing a wide range of sounds, tones and signals from the loudspeaker. This permits selection of a tone which differs sufficiently from the ambient noise to assure attracting attention. By the use of chopped d.c. to drive the speaker, the expense, weight and bulk of an impedance matching transformer is eliminated. A plurality of individually operable switches are provided for switching circuit elements in and out of circuit to modify wave shapes and alter sound output. Another group of individually operable switches mixes selected wave shapes to produce various compound waves and produce additional sound variations. One switch provides pitch control and another provides output volume control.

14 Claims, 2 Drawing Figures

PROGRAMMABLE ELECTRONIC SIREN

BACKGROUND OF THE INVENTION

1. Field of the Invention

The present invention relates to electronic siren circuits and more specifically to circuit means for operating a permanent magnet loudspeaker as a siren from a source of chopped d.c. signals. Selectively operable switches connect circuit elements for signal modification.

2. Description of the Prior Art

Prior art electronic circuits such as those shown in U.S. Pat. No. Re. 28,745 issued Mar. 23, 1976, to G. D. Smith and U.S. Pat. No. 3,051,944 issued Aug. 28, 1962, to the same inventor, disclose electronic siren circuits which use an impedance matching transformer between the speaker terminals and the power amplifier. This is standard practice in speaker operation so that during the positive half of an a.c. signal the speaker cone may be pushed in one direction, and during the negative half of the a.c. signal, the speaker cone may be pulled in an opposite direction. D.C. signals to permanent magnet speakers have been considered unsatisfactory because they can push the speaker cone, but not pull it, or vice versa.

Some prior art electronic horns or sirens have included means for altering at least the output sound level. Some have included means for producing a very limited number of different sounds. For example, one commercial model provides for use of up to three of a plurality of about ten available circuit boards. By selective switching, any one of the three circuit boards may be made to control the output sound.

SUMMARY OF THE INVENTION

A dynamic loudspeaker is connected in the emitter-collector circuit of a transistor which is controlled by a voltage controlled oscillator which, under control of other circuit elements, is made to produce a wide variety of cyclically varying output signals for producing a wide range of sounds, tones, and signals from the speaker. A diode is connected as a free wheeling diode in parallel with the speaker voice coil to dissipate the inductive energy in the speaker coil when the transistor is turned off. Operator of the speaker from chopped d.c. permits the elimination of a bulky, costly and heavy impedance matching transformer and, therefore, permits a more economical, lighter and smaller electronic siren apparatus. A number of selectively adjustable individual switches are provided for switching elements in and out of circuit to control amplifiers, oscillators or other components, and vary the shape, rate of change, and cyclical repetition rate of the signal applied to the speaker. By this means, a wide range of sounds may be selectively generated and a particular one chosen which is most suitable, considering the ambient noise conditions within which the electronic siren will be operated. In one embodiment, eight individual switches are used, and a total of over 225 sound variations may be produced without any wiring or component changes.

While the switches are indicated as manual switches, it would be possible to provide switches which respond to a programmed input signal so that the audible tone generated could be controlled by the programmed input signal.

It is a principal object of this invention to provide a new and improved electronic siren.

It is a more specific object of the invention to provide an electronic siren circuit utilizing a permanent magnet speaker which is driven by a chopped d.c. signal.

It is another object of the invention to provide a new and improved electronic siren circuit using a permanent magnet speaker without requiring an impedance matching transformer.

It is another object of the invention to provide an electronic siren circuit which is capable of producing a wide variety of sounds.

It is another object of the invention to provide an electronic siren which may be controlled to produce a sound which has a suitable character for attracting attention irrespective of the makeup of ambient sounds.

It is another object of the invention to provide an electronic siren including means for shifting the pitch of the sound output.

It is another object of the invention to provide an electronic siren structure which produces a wide range of output sounds without any wiring or component changes.

It is another object of the invention to provide circuit means for dissipating the inductive energy in the speaker coil during the off time of the chopped d.c. input signal.

BRIEF DESCRIPTION OF THE DRAWING

The above-mentioned and other features, objects and advantages of the invention, together with the manner of attaining them, will become more apparent as the following description is considered, together with the drawing in which.

Figure 1:
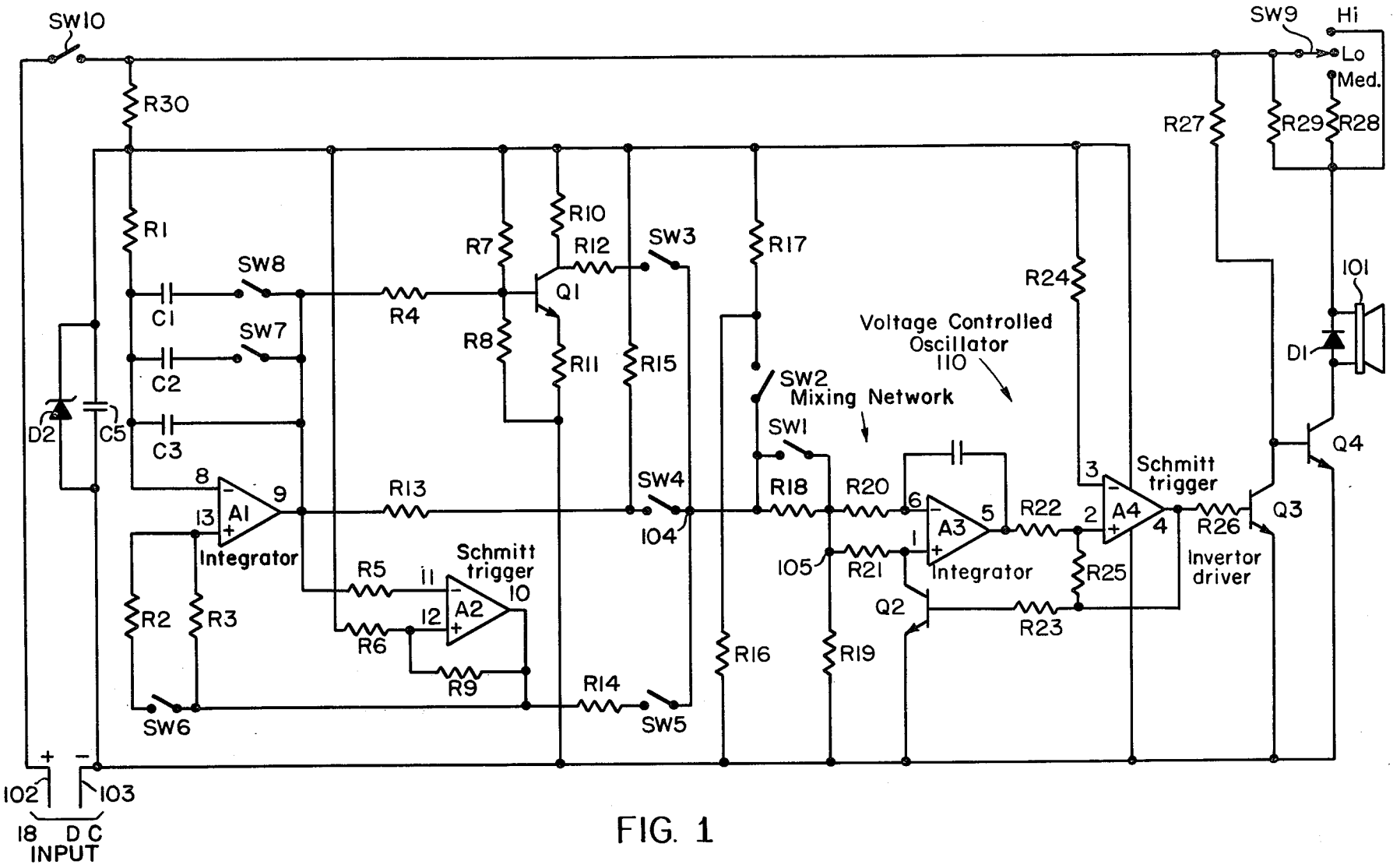
FIG. 1 constitutes a circuit diagram of the electronic siren.

The schematic circuit of FIG. 1 discloses one form of the invention and is not meant in any way to delimit its scope, but is intended as an aid in understanding the invention. Standard electrical symbols are used to illustrate conventional components.

For convenience in identifying the nature and function of various components of FIG. 1, a prefix letter has been used. The prefixes R and C represent resistors and capacitors, respectively. Prefixes A and Q refer to operational amplifiers and transistors, respectively, while prefixes D and SW identify diodes and switches, respectively.

DESCRIPTION OF THE PREFERRED EMBODIMENT

Referring now more specifically to FIG. 1, there is illustrated in schematic form a circuit for driving a speaker 101 which may comprise a permanent magnet speaker having a voice coil (not specifically and individually shown) to which an electrical input is applied. As will be seen, a diode D1 is connected in parallel with the speaker 101. Terminals 102 and 103 are connected to the positive and negative terminals, respectively, of a d.c. power source (not shown) which may comprise any suitable power supply including an alkaline battery. Switch SW10 connects the d.c. power supply to the circuit and actuates the circuit. Switch SW10 may comprise a manually actuated test switch and/or a normally open contact that is closed in response to any action which should initiate the sounding of the speaker 101. For example, the switch SW10 might be closed in response to a temperature outside a predetermined range;

a broken window; loss of power; smoke or any of numerous other conditions which may be detected and cause the closing of a switch.

An integrated circuit including four operational amplifiers A1, A2, A3 and A4 is employed. The operational amplifiers A1 and A3 serve as integrators while the operational amplifiers A2 and A4 are Schmitt triggers. When switch SW10 is closed to apply power, positive potential is applied through resistors R30 and R1 to the A1 operational amplifier and also through resistors R30 and R6 to the A2 operational amplifier. The operational amplifier A1 is connected as an integrator and charges the timing capacitor C3, and if switch SW7 is closed, timing capacitor C2 will be charged, and if switch SW8 is closed, timing capacitor C1 will be charged. The output of the Schmitt trigger A2 is fed back through resistor R3 (and resistor R2 in parallel if switch SW6 is closed) into the operational amplifier A1 so that a rising and falling triangular wave form is produced at output terminal 9 of the operational amplifier A1. The output potential of the operational amplifier A1 does not fall to the negative reference potential nor rise to the positive reference potential of the power source connected to terminals 102 and 103. The Schmitt trigger A2 produces at its output terminal 10 a square wave signal varying between the plus and minus reference potentials.

When all the timing capacitors C1, C2 and C3 are connected into the circuit, the output signal of the integrator A1 ramps up for approximately four seconds and ramps down for approximately four seconds. With only capacitor C3 in the circuit, the ramp up and ramp down time of the output of integrator A1 is approximately two tenths of a second. While the output of integrator A1 is ramping up, the Schmitt trigger A2 provides a high level output and while the integrator A1 is ramping down, the Schmitt trigger A2 provides a zero level output at terminal 10.

When switch SW6 is not closed to connect resistor R2 in the circuit to the input of integrator A1, the output of integrator A1 has approximately equal up and down ramp times. However, when switch SW6 is closed to connect resistor R2 in parallel with resistor R3, the up ramp time is reduced to about five percent of its original time while the rap down time is uneffected. With the reduced up ramp time of the output of integrator A1, the time that the Schmitt trigger A2 provides a high potential output at terminal 10 is greatly reduced. Resistors R5, R6 and R9 coupled to the Schmitt trigger A2 provide an appropriate bias.

Transistor Q1 is arranged as a controlled gain emitter-follower and the associated resistors R4, R7, R8, R10 and R11 provide appropriate biases. The output of integrator A1 is coupled via resistor R4 to the base of transistor Q1 and controls the conduction of transistor Q1. Accordingly, the ramping output of integrator A1 is inverted by transistor Q1 and appears at the collector of transistor Q1.

As may be seen, the collector signal of transistor Q1 will be applied to terminal 104 if switch SW3 is closed. In a similar manner, the output of integrator A1 will be connected to terminal 104 through resistor R13 if switch SW4 is closed. And the output of Schmitt trigger A2 will be coupled to terminal 104 through resistor R14 if switch SW5 is closed. Terminal 104 is coupled through resistors R18 and R20 as an input to integrator circuit A3. Accordingly, depending upon the closure of one or more of the switches SW3, SW4 and SW5, the outputs, or a combination thereof, of the integrator A1, the Schmitt trigger A2 and the controlled gain emitter-follower Q1 may be applied as an input to integrator A3. Resistor R12 balances the output of transistor Q1 to the output of integrator A1 through resistor R13, and the outut of Schmitt trigger A2 through resistor R14. Resistors R13 and R14 serve to provide source and sink current limiting to the outputs of the integrator A1 and Schmitt trigger A2, respectively. Resistor R15 serves to pull up the lower voltage limit of the output wave signal from integrator A1.

The integrator A3 and the Schmitt trigger A4 combine to form a voltage controlled oscillator 110 with the integrator A3 producing a saw tooth output signal at the terminal 5 and the Schmitt trigger producing an unsymmetrical square wave output at terminal 4. The potential at the junction 105 of resistors R20 and R21 controls the output frequency of the voltage controlled oscillator 110 at terminal 4 of the Schmitt trigger A4. A zero potential (or current) at junction 105 produces a high output potential at terminal 4 while a one volt potential at junction 105 produces a very low audio frequency oscillation at terminal 4 and as the voltage at junction 105 is raised, a correspondingly higher frequency output results at output terminal 4 of Schmitt trigger A4. Thus, a change in potential at point 105 changes the signal to the loudspeaker 101 and the character of the sound output.

Resistors R22, R24 and R25 bias the Schmitt trigger A4. Resistor R23 supplies base current to the transistor Q2 when the output terminal 4 of Schmitt trigger A4 is high. When transistor Q2 is turned on, it clamps terminal 1 of integrator A3 low. This action occurs during the ramp down time of integrator A3. The resistors R20 and R21 which are coupled to the input terminals 6 and 1, respectively, of integrator A3 are in the ratio of approximately five to one and, therefore, the output of the voltage controlled oscillator 110 at terminal 4 has approximately an 80 percent on time and 20 percent off time of the audio output signal.

Resistor R26 coupling the output terminal 4 of the voltage controlled oscillator to the base of transistor Q3 provides base current to transistor Q3 and its collector has a wave form with approximately twenty percent on time.

The transistors Q3 and Q4 are connected as a Darlington amplifier to provide for control of a relatively large current through the speaker 101 by the small control current output at terminal 4 of the voltage controlled oscillator 110 comprising operational amplifiers A3 and A4. This facilitates elimination of a speaker transformer.

Resistor R27 coupled to the collector of transistor Q3 supplies base current to the power transistor Q4 which in turn supplies the chopped d.c. current to the speaker 101. The speaker coil of speaker 101 is displaced in the permanent magnetic field in response to the collector current of transistor Q4 and depends on diaphragm resiliency to return to its neutral position. That is, the current in the speaker coil is a chopped d.c. current and pushes the diaphragm in one direction, but does not pull it back in the other direction. In a more conventional speaker circuit, an alternating current signal is applied to the voice coil and the diaphragm is alternately pulled and pushed.

A conventional square wave has a 50 percent on and a 50 percent off time. However, as indicated above, the circuit constants provide for approximately a 20 percent on time of transistor Q3. It has been found that this provides sufficient power to produce maximum audible sound output. That is, with a 20 percent on time, the cone of speaker 101 will be displaced its maximum extent. Since the cone of the speaker is not pulled back to its zero, or neutral, position, more time is required for the return; the 80 percent off time provides the extra time. Full return of the cone of the speaker 101 assures maximum sound output.

The diode D1 is connected as a free wheeling diode and dissipates the inductive energy stored in the magnetic field of the speaker 101 when transistor Q4 turns off.

Switch SW9 is a three position switch which controls the magnitude of the current through speaker 101 and hence the output sound level. With the switch in the HI position, maximum current may flow through speaker 101; with the switch SW9 in MED position, resistors R28 and R29 are coupled in parallel and connected in series with speaker 101 and limits the current; and with switch SW9 in the LO position, resistor R29 is in series with speaker 101 and further limits the current in speaker 101. The value of the resistors R28 and R29 will depend upon the applied potential, the power handling capabilities of transistor Q4 and the loudspeaker 101 as well as the maximum and minimum sound levels desired.

When switch SW2 is closed, the junction point of resistors R16 and R17 is coupled to junction 104 and provides a fixed d.c. voltage to the input of integrator A3 of the voltage controlled oscillator 110. This produces a fixed frequency output from the speaker 101. When switch SW2 is closed in combination with one or more of the switches SW3, SW4 and SW5, it produces modifications of the signal at point 104 and generally pulls down the top of the wave form and pulls up the bottom to reduce the spread of the output frequency. As an example, if switch SW5 is the only switch closed, a beeping tone will be produced, but if switch SW2 is closed in combination with switch SW5 to cause the wave form to switch between a high and low voltage limit, there will be an alternating high and low frequency sound output. When switch SW6 is closed, the wave form output from Schmitt trigger A2 consists of short d.c. pulses lasting only for the duration of the rise time on the saw-tooth wave at output pin 9 of Integrator A1 and spaced apart by the fall time. With C3 only in the circuit (i.e. with switches SW7 and SW8 open), this circuit gives a rapid "knock sound" as short bursts are produced at the output 4 of the voltage controlled oscillator. Closing switches SW7 and SW8 lengthens the off time at output point 10 of the Schmitt trigger A2 and proportionately stretches the d.c. pulse time to give a distinctive trouble beep signal. A knock sound and horn sound can be combined to give an output sound retaining the characteristics of both these original sounds, thus allowing annunciation of two signals at the same time from a single signalling device.

Switch SW1 shunts resistor R18 to change the audible pitch of all sounds generated from a low pitch to a high pitch as desired to overcome ambient background noise.

Resistor R19 is added to reduce the susceptibility to leakage currents.

The circuit may be arranged on a printed circuit board. Sealing the board with varnish helps avoid difficulty and leakage resulting from high humidity.

The diode D1 should be omitted if conventional a.c. audio signls are also to be switched into the speaker 101.

Resistor R30 and zener diode D2 across capacitor C5 provides a fixed voltage clamp.

Figure 2:
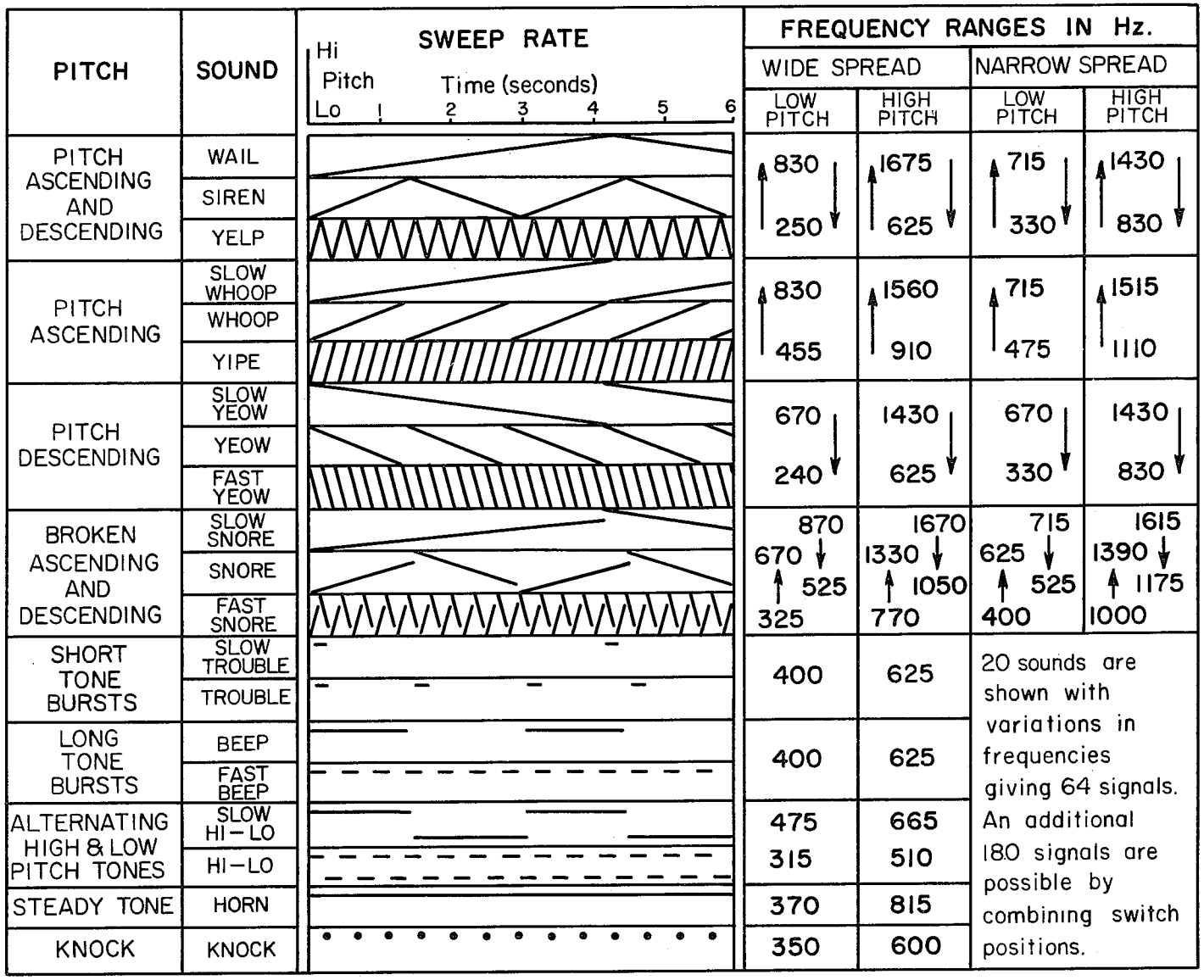
FIG. 2 comprises a chart illustrating some of the sounds provided as a plot of time versus pitch.

Considering now more specifically FIG. 2, there will be seen an illustration of a few of the available sounds shown as a plot of time versus pitch for selected sounds. These plots also represent the input voltage curves to the voltage controlled oscillator 110 comprising the integrator A3 and the Schmitt trigger A4. The first column of the chart of FIG. 2 designated PITCH indicates the manner in which the pitch of the output sound of the speaker 101 may be varying. The second column of the chart of FIG. 2 associates a name with each of the various sounds illustrated. The sound names are chosen to give some indication of the nature and characteristic of the sound. The third column designated SWEEP RATE provides the mentioned plot and an indication of the repetition rate of the sound. The remaining columns indicate the range of frequencies which produce the sounds.

Considering first, for convenience, the sound designated "Yelp", it will be seen that it constitutes a sound, as indicated in the first column, wherein the pitch alternately ascends and descends. As may be seen in the third column, there are approximately three cycles of ascending and descending pitch per second. If appropriate switches are actuated to provide widespread and low pitch, the output frequency will rise from approximately 250 Hz to 830 Hz and then fall from approximately 830 Hz to 250 Hz and repeat continuously at a rate of about three cycles per second. If the high pitch frequency switch SW1 is actuated, the "Yelp" sound will be produced with the output frequency ranging between approximately 625 Hz and 1675 Hz. If the narrow spread switch and low pitch switches are actuated, the sound will vary from approximately 330 to 715 Hz; while with the narrow spread switch and high pitch sound switches actuated, the output frequency will range between approximately 830 Hz and 1430 Hz.

Switch SW1, when closed, will shunt resistor R18 and result in a higher pitch output from the speaker 101. When switch SW1 is open and resistor R18 is unshunted, the speaker 101 will provide the low pitch output. Switch SW2 controls the wide or narrow spread of the frequency ranges. With switch SW2 closed, resistors R16 and R17 supply a fixed d.c. voltage to the input of the voltage controlled oscillator. Switch SW2 also provides for modification of the wave forms from switches SW3, SW4 and SW5 generally pulling down the top of the wave form and pulling up the bottom to reduce the spread of the output frequency swing.

As will be seen, the "Siren" sound may have substantially the same frequency range as the "Yelp", sound, but instead of having approximately three periods per second, it has only one period in three seconds. As may be seen, the "Wail" sound has the same frequency range as both the "Yelp" and the "Siren", but has a period of approximately eight seconds. As may be seen from the chart of FIG. 2, the "Slow Whoop", the "Whoop" and the "Yipe" all have similar frequency makeups, but vary in their pulse repetition rate. For these sounds, the pitch begins at a low value and ascends to a high value and then instantaneously drops to the low value and ascends again.

Other sounds and their frequency characteristics may be determined by further analysis and consideration of the data shown in the chart of FIG. 2.

Some sounds may comprise short tone bursts such as the "Slow Trouble" and "Trouble" sounds and others may comprise long tone bursts such as the "Beep" and "Fast Beep" sounds or alternating high and low pitch tones.

As indicated, several dozen other sounds may be generated by selectively actuating the switches SW1 to SW8 in various combinations. The most distinctive and most easily described and illustrated are shown in the chart of FIG. 2. Variations obtained by actuating other switches allow selection of a particular sound which will be able to attract attention irrespective of the ambient sound.

With switches SW2 through SW5 opened, no signal is applied to the input of the voltage controlled oscillator and there can be no sound output. Any or all of the tones may be produced without any wiring or component changes other than the actuation of the switches SW1 to SW8. Accordingly, if the switches SW1 to SW8 are arranged for remote control, it is possible to cause one of the electronic sirens to selectively produce any of the wide range of signals and thereby provide a single unit for producing various signals which will convey various pieces of information.

While there has been shown and described what is considered at the present to be the preferred embodiment of the invention, modifications thereto will readily occur to those skilled in the related arts. For example, different input potentials could be used, increased amplification and higher output speakers could be used, and other circuit constants could be used to provide modified sound output. It is believed that no further analysis or description is required and that the foregoing so fully reveals the gist of the present invention that those skilled in the applicable arts can adapt it to meet the exigencies of their specific requirements. It is not desired, therefore, that the invention be limited to the embodiments shown and described, and it is intended to cover in the appended claims all such modifications as fall within the true spirit and scope of the invention.

What is claimed is:

1. An electro-acoustic transformation system comprising in combination:
   a. a loudspeaker having a permanent magnet field, a cone and a voice coil for responding to changing currents to move the cone and produce sound;
   b. a transistor having its collector-emitter elements coupled in series with the voice coil of said loudspeaker and the series combination coupled across a d.c. power supply; and
   c. a voltage controlled oscillator coupled to the base of said transistor for providing a chopped d.c. potential having an on-time of the order of 25 percent to control the conduction of said transistor and concomitantly the current in the voice coil of said loudspeaker and the sound produced by said loudspeaker.

2. The combination as set forth in claim 1 and including a diode in parallel with said loudspeaker for dissapating the inductive energy stored in the voice coil of said loudspeaker when said transistor is turned off.

3. The combination as set forth in claim 1 and including selectively adjustable switch means which may be adjusted for controlling the input signal to said voltage controlled oscillator.

4. The combination as set forth in claim 3, wherein the input signal applied to said voltage controlled oscillator may comprise a combination of one or more input signals in response to the selected adjustment of said selectively adjustable switch means.

5. The combination as set forth in claim 4, wherein said selectively adjustable switch means comprises a plurality of individual switches each of which are selectively operable.

6. The combination as set forth in claim 5, wherein a first one of said input signals may comprise:
   a. a first saw tooth signal having approximately equal ramp up and down time;
   b. a second saw tooth signal similar to said first saw tooth signal but having a substantially higher frequency; or
   c. a third saw tooth signal which may selectively have the frequency of either of said first or second saw tooth signals but unequl ramp up and ramp down times.

7. The combination as set forth in claim 6, wherein a second one of said input signals may comprise a signal which is the inverse of said first one of said input signals.

8. The combination as set forth in claim 7, wherein a third one of said input signals may comprise;
   a. a first square wave signal which has a high and low output level in response to a ramp up and a ramp down, respectively, of said first one of said input signals.

9. The combination as set forth in claim 8, wherein a fourth one of said input signals may comprise a fixed d.c. potential.

10. The combination as set forth in claim 9 and wherein said selectively adjustable switch means includes a control switch for independently altering the audible pitch of the sounds produced by said loudspeaker irrespective of the adjustment of the remainder of said selectively adjustable switch means.

11. In an electronic siren the combination comprising:
   a. a voltage controlled oscillator;
   b. a loudspeaker coupled to the output of said voltage controlled oscillator;
   c. first, second and third circuit means for generating first, second and third input signals for selective coupling to said voltage controlled oscillator;
   d. said first input signal selectively comprising;
      1. a first saw tooth wave having approximately equal ramp up and ramp down times;
      2. a second saw tooth wave similar to said first saw tooth wave but having a substantially higher frequency; and
      3. a third saw tooth wave which may have the frequency of either of said first or second saw tooth waves but unequal ramp up and ramp down times;
   e. said second input signal comprising a signal which is the inverse of said first input signal; and
   f. said third input signal comprising a square wave having a high and low level in response to a ramp up and a ramp down, respectively, of said first one of said input signals.

12. The combination as set forth in claim 11 and including a fourth circuit means for coupling a fourth input signal to said voltage controlled oscillator wherein said fourth input signal comprises a fixed d.c. potential.

13. The combination as set forth in claim 12 and including a plurality of selectively adjustable switch means for selectively couplng one or more of said first, second, third and fourth input signals to said voltage controlled oscillator for controlling the audio output of said loudspeaker.

14. The combination as set forth in claim 13 and wherein said selectively adjustable switch means includes a control switch for independently altering the audible pitch of the sounds produced by said loudspeaker irrespective of the adjustment of the remainder of said selectively adjustable switch means.

* * * * *